US006250088B1

(12) United States Patent
Johansson

(10) Patent No.: US 6,250,088 B1
(45) Date of Patent: Jun. 26, 2001

(54) METHOD AND APPARATUS FOR COOLING A PRODUCT USING A CONDENSED GAS

(75) Inventor: Sven Åke Johansson, Enskede (SE)

(73) Assignee: AGA AB, Lidingo (SE)

( * ) Notice: Subject to any disclaimer, the term of this patent is extended or adjusted under 35 U.S.C. 154(b) by 0 days.

(21) Appl. No.: 09/367,377

(22) PCT Filed: Feb. 12, 1998

(86) PCT No.: PCT/SE98/00248

§ 371 Date: Aug. 12, 1999

§ 102(e) Date: Aug. 12, 1999

(87) PCT Pub. No.: WO98/36212

PCT Pub. Date: Aug. 20, 1998

(30) Foreign Application Priority Data

Feb. 14, 1997 (SE) ..... 9700523

(51) Int. Cl.[7] ..... F25D 17/02; F25D 29/00

(52) U.S. Cl. ..... 62/98; 62/515; 62/59; 165/902; 165/10; 165/61

(58) Field of Search ..... 62/515, 98, 59; 165/902, 10, 61

(56) References Cited

U.S. PATENT DOCUMENTS

| | | | | |
|---|---|---|---|---|
| 3,587,731 | | 6/1971 | Hays . | |
| 4,171,069 | * | 10/1979 | Cornelius et al. | 222/1 |
| 4,370,864 | * | 2/1983 | Wessa | 62/98 |
| 5,220,954 | * | 6/1993 | Longardner et al. | 165/10 |
| 5,435,155 | * | 7/1995 | Paradis | 62/515 |
| 5,511,384 | * | 4/1996 | Likitcheva | 62/59 |
| 5,560,222 | * | 10/1996 | Perron | 62/435 |
| 5,957,193 | * | 9/1999 | Kanada | 165/10 |
| 6,101,837 | * | 8/2000 | Imanari et al. | 62/434 |

FOREIGN PATENT DOCUMENTS

| | | |
|---|---|---|
| 40 01 330 A1 | 7/1991 | (DE) . |
| 0 546 947 A1 | 6/1993 | (EP) . |
| 63-275897 | 11/1988 | (JP) . |

* cited by examiner

*Primary Examiner*—William Doerrler
*Assistant Examiner*—Mark Shulman
(74) *Attorney, Agent, or Firm*—Pearne & Gordon LLP

(57) ABSTRACT

Method for cooling a product, preferably in gas or liquid form, using the cooling content of a condensed gas, where the condensed gas is vaporized in a vaporization heat exchanger arrangement and the product is cooled in a product-cooling heat exchanger arrangement. Both the vaporization and the product-cooling take place under energy exchange with the vaporized gas. As heat exchanger arrangements, use is made of a combined arrangement (1) comprising a plurality of passages (A, B, C) which are in heat-transferring contact with one another and are used for the different media. The passages (A)_ intended for vaporization of the condensed gas are coupled in parallel between an inlet (5) and an outlet (6) and the media are supplied to the passages so that between a passage (A) for the condensed gas and a passage (C) for the product to be cooled there is at all times at least one passage (B) through which vaporized gas flows. The invention also relates to an arrangement intended to be used in implementing the method.

10 Claims, 3 Drawing Sheets

A B C B A B C B A B C

METHOD AND APPARATUS FOR COOLING A PRODUCT USING A CONDENSED GAS

The present invention relates to a method for cooling a product, preferably in gas or liquid form, using the cooling content of a condensed gas, where the condensed gas is vaporized in a vaporization heat exchanger arrangement and the product is cooled in a product-cooling heat exchanger arrangement, and where both the said vaporization and the product-cooling take place under energy exchange with the vaporized gas. The invention also includes an arrangement for use in implementing the method.

Many large users of gas have this gas supplied in condensed form. When the gas is to be used, it is generally vaporized in an air vaporizer. The use of air vaporizers means the cooling content of the condensed gas is lost. To be able to make use of the cold which is presently lost in this way, flexible and inexpensive equipment is needed which can be used for cooling a number of different products, preferably in gas or liquid form, without them freezing. The equipment must also work without the use of any additional heat transfer medium with low freezing point, which is cooled by the condensed gas and in turn cools the product, because this requires the use of a pump or similar supplying energy to the heat transfer medium, which reduces the cooling content of the latter.

Heat exchangers of the twin tube type having previously been used, see DE-A1-4001330, for cooling a product with condensed gas. The condensed gas in these undergoes vaporization during passage through a central tube, after which the vaporized gas returns to a space of annular cross-section outside this tube and inside a second tubular wall. The product to be cooled is then allowed to pass through an annular space outside this second tubular wall.

In one embodiment described in DE-A1-4001330 the condensed gas is vaporized during passage through a number of straight sections of a central tube. All tube sections are connected in series and forms a single central tube of meander form.

The advantage of a twin tube arrangement is that it is possible to achieve a continuous process, which can be adapted to specific requirements, since the capacity of the arrangement is determined, inter alia, by the length of the twin tube.

Disadvantages of such a heat exchanger of the twin tube type are that the cost of manufacture is relatively high and, at the same time, the volume and the material consumption are high in relation to the capacity obtained. These disadvantages become even more apparent in the above mentioned embodiment which uses parallel-coupled passages for two of the media and series-coupled passages for the condensed gas.

JP 63-275897 discloses an apparatus in which an intermediate thermal medium is cooled in a first heat exchanger comprising only two sets of passages. This intermediate thermal medium is then passed to a second heat exchanger for cooling a product.

Compared to tube-type heat exchangers, plate-type heat exchangers, i.e. heat exchangers made up of a plurality of parallel plates of large surface area which are arranged at a small distance from each other and between them form passages for the various media, provide a substantially greater heat exchanger capacity per unit of volume. The material consumption and the manufacturing costs are also much lower than for corresponding tube-type heat exchangers. It is thus simple and inexpensive to manufacture small plate-type heat exchangers with relatively high capacity.

In our own WO 95/24585, a method and an arrangement are described for cooling a product using condensed gas, which permits the use of simple and inexpensive standard heat exchangers of the plate type. However, it is necessary there to use a plurality of heat exchangers designed as discrete components.

An object of the present invention is to make available a method and an arrangement for cooling a product with condensed gas, without the risk of the product freezing, which permits a continuous process using a plate-type heat exchanger whose capacity can be easily adapted depending on the specific requirements.

The basis of the invention is the realization that this can be achieved with the aiad of a plate-type heat exchanger having a plurality of passages which are located one after the other and are supplied with the media in a certain defined order.

According to the present invention, the special characteristic of a method of the type cited in the first paragraph is that, as the said heat exchanger arrangements, use is made of a combined arrangement comprising a plurality of passages which are in heat-transferring contact with one another and are used for the different media, that at least the passages intended for vaporization of the condensed gas are coupled in parallel between an inlet and an outlet, and that the media are supplied to the passage so that between a passage for the condensed gas and a passage for the product to be cooled there is at all times at least one passage through which vaporized gas flows.

This method permits the use of a simple, inexpensive and compact plate-type heat exchanger arrangement with an easily adaptable capacity for the desired cooling, which can be done without any risk of freezing.

It is preferable for the passages for each medium to be coupled in parallel, and for the common outlet from the passages supplied with the condensed gas to be coupled to the common inlet of the passages for the vaporized gas. A simple coupling together of the passages is achieved in this way.

For efficient heat exchange, it is preferable for the passages to be coupled in such a way that the vaporized gas comes to flow in counter-current direction in relation to the direction of flow of the product.

The combined heat exchanger arrangement is expediently designed in the form of an arrangement with a plurality of column-shaped passages which are disposed side by side and are separated by partition walls with a large heat-transfer surface area. This permits a very compact and efficient heat exchanger arrangement.

The special characteristic features of an arrangement for use in implementing the method will be evident from the attached patent claims.

The invention will be described in greater detail hereinbelow, with reference to the embodiments which are shown as examples in the appended drawings.

Figure 1:
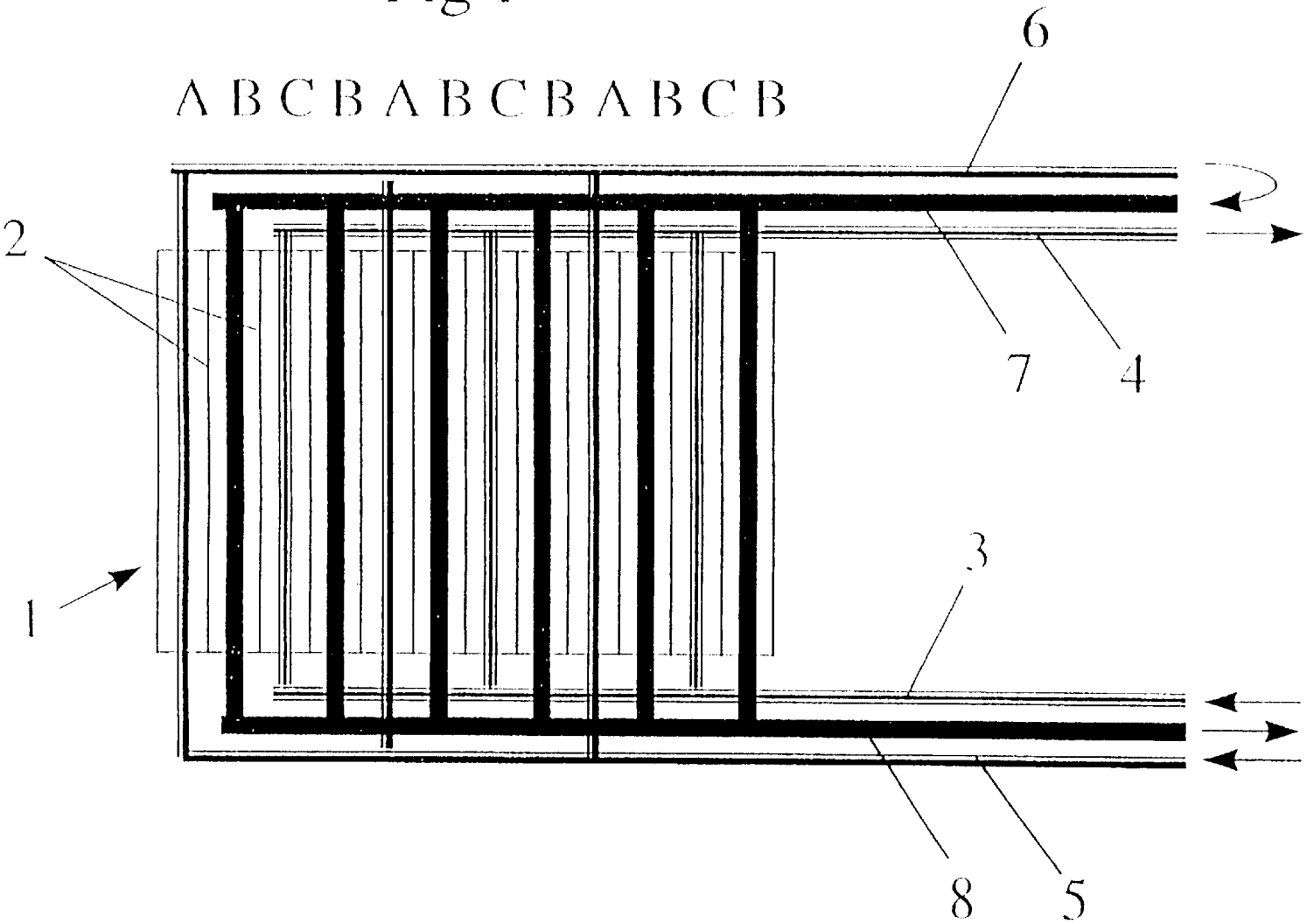
FIG. 1 illustrates diagrammatically a first embodiment of a heat exchanger for three media, and the connections of the various passages upon application of the invention.

In FIG. 1, reference number 1 designates a diagrammatically represented plate-type heat exchanger for three media, with a plurality of passages A, B, C formed between thin heat-transfer plates 2. Those surfaces of the plates 2 facing towards the passages A–C can be specially designed to increase the total surface area of the plates, which surface area comes into contact with the respective medium. In practice, the accesses to the various passages are expediently designed in the form of tube passages passing through the whole series of plates, and with selective outlets in chosen passages.

In the embodiment shown in FIG. 1, the product to be coupled, which is expediently in liquid or gas form, is supplied via a line 3, which is connected to the passages designated C in the heat exchanger arrangement 1. The cooled product leaves the heat exchanger via a line 4.

The condensed gas, whose cooling content is intended to be used for cooling the product, is supplied via a line 5 to all the passages designated A in the heat exchanger arrangement 1. The gas has to have a lower boiling point than the target temperature of the product, and can consist, for example, of nitrogen, argon, oxygen, carbon dioxide or natural gas. The arrangement is designed in such a way that complete vaporization of the gas is achieved in the passages A, and the vaporized gas in line 6 is coupled in to line 7 and supplied to all the passages designated B in the heat exchanger arrangement 1. Thereafter, the vaporized gas leaves via a line 8 and can be used in any subsequent process. Because of the high admission pressure of the condensed gas, no pump or fan is needed for circulation of the vaporized gas.

It will be appreciated that the capacity of the heat exchanger arrangement shown can be modified as required by increasing or reducing the length of the passages and/or the number of passages used.

In the embodiment shown, there is a passage B for vaporized gas located between each passage C for the product and each passage A for the cold, condensed gas. This is of crucial importance since in this way an indirect cooling of the product is achieved using the cooling content of the condensed gas, with insignificant risk of the product freezing. This is done without the use of a separate heat transfer medium, since the vaporized gas serves as heat transfer medium and is driven around in the system as a consequence of the overpressure in the admission line 5.

Nor is there any direct contact between the product and the gas which is used for cooling it. For especially critical applications, it is also possible to use extra passages between product and gas for detecting any leakage.

The described heat exchanger arrangement is very efficient, since the vaporized gas is used on the one hand for cooling the product, which entails an increase in temperature of the condensed gas, and on the other hand for heating the condensed gas for vaporization thereof. Both the product-cooling and the vaporization take place under energy exchange with one and the same medium, namely the vaporized gas.

In the embodiment shown, the vaporized gas flows in counter-current direction in relation to both the product and the condensed gas. However, other combinations of the co-current and counter-current can also be used.

Applying the principle shown here, it is also possible to cool several products in the same arrangement, in which case, for example, it is possible to arrange several passages for products between each pair of passages for vaporized gas, or to couple different product passages to different attachment lines.

In the embodiment according to FIG. 1, all the passages are coupled in parallel between associated inlet and outlet lines. However, it is also possible to couple in series the passages for the vaporized gas and/or the product to be cooled.

Figure 2:
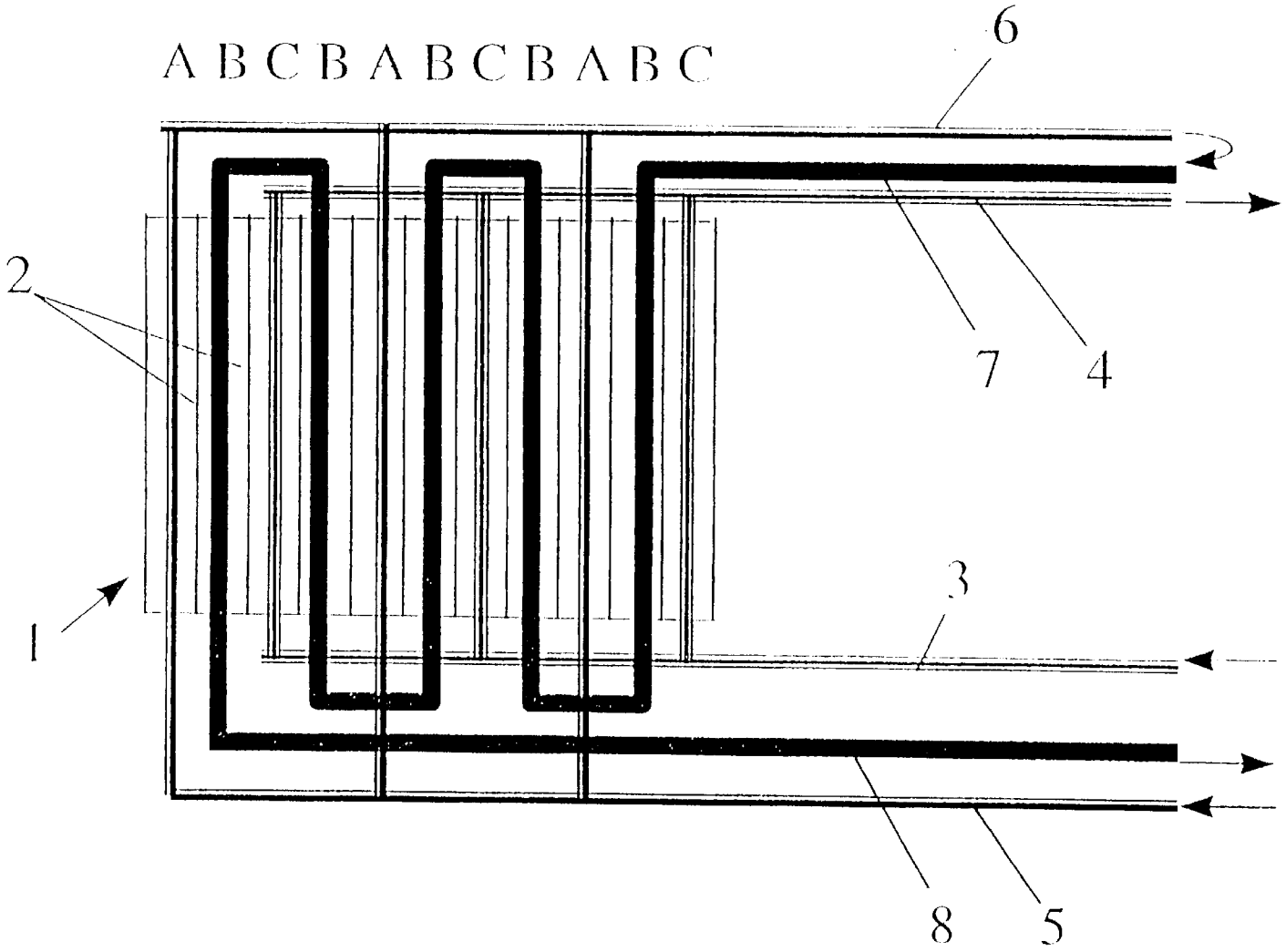
FIGS. 2 and 3 illustrate two further embodiments of a heat exchanger arrangement which can be used upon application of the invention.

FIG. 2 shows such an example, where the passages B for the vaporized gas are coupled in series between the inlet line 7 and the oulet line 8. This has been done while retaining the same passage sequence as in FIG. 1, which is a prerequisite. In this embodiment, however, the flow relationships in the different passages change between co-current and counter-current. Corresponding series-coupling of the passages for the product to be cooled is also possible.

Figure 3:
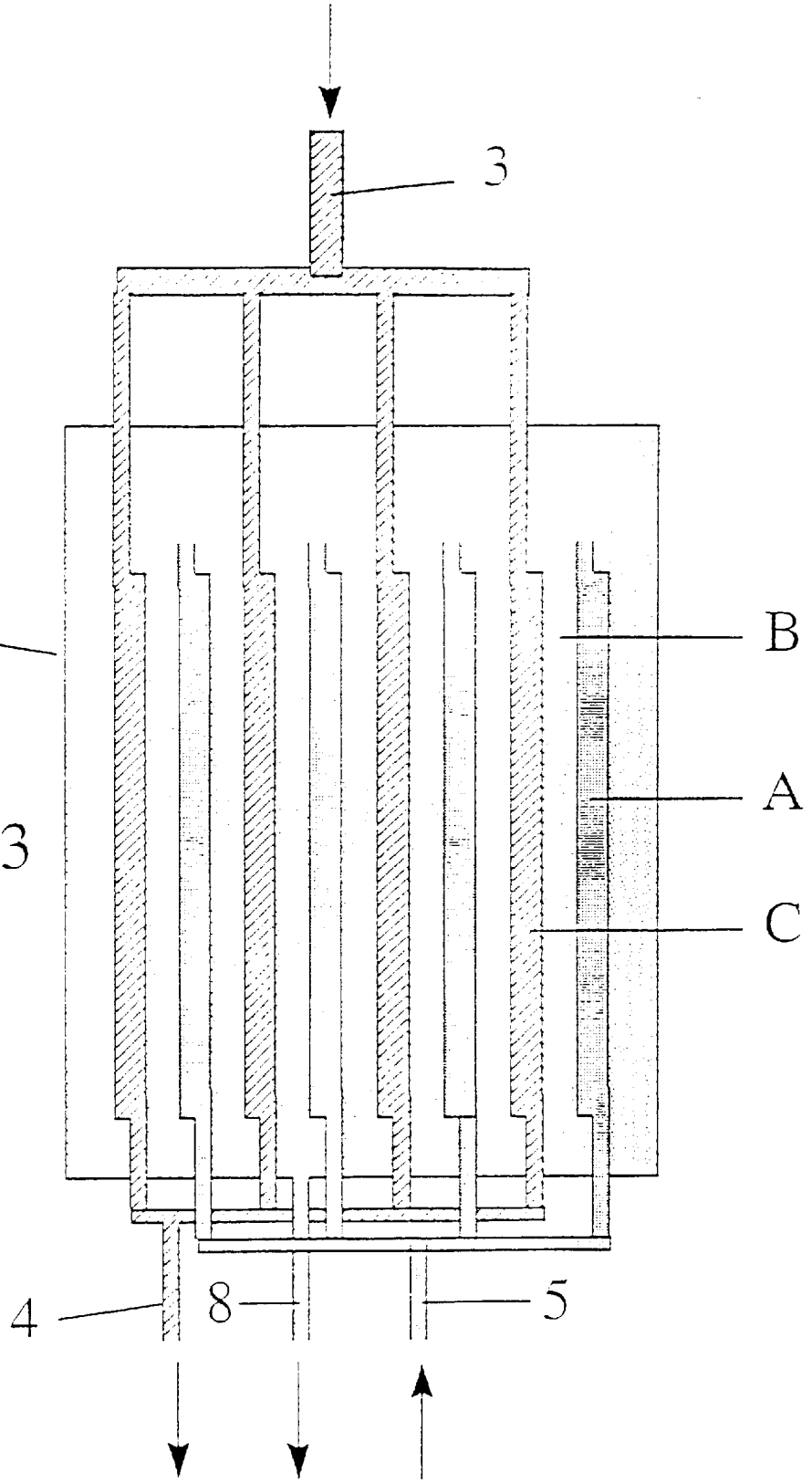

FIG. 3 shows an alternative embodiment in which use is made of a closed container 9, with passages A and C, arranged at a distance from each other, for the condensed gas and, respectively, the product to be cooled. At one end of the container 9, the passages A are connected to a common inlet line 5, while the other ends of these passages are open at the other end of the container. The gas vaporized in the passages A can thus flow freely out into the container 9.

Between each pair of passages A in this embodiment there is a passage C for the product to be cooled. These passages are coupled in parallel between an inlet 3 and an outlet line 4. Formed between each pair of passages A and C there is a column-shaped passage in the container 9, through which columns the vaporized gas can pass to a common outlet line 8. As in the previous embodiments, the vaporized gas comes to serve the dual purpose of, on the one hand, cooling the product in the passages C, and, on the other hand, heating the condensed gas in the passages A for vaporization of said gas. The passages A and C are constructed using the same technique employed in conventional plate-type heat exchangers.

The invention has been described above with reference to the embodiments shown in the drawings. However, these can be varied in several respects within the scope of the patent claims. Thus, for example, the number of passages can be chosen in accordance with requirements, and they can also be divided up into more than three groups, provided that the passage sequence is such that the passages for the product to be cooled never directly adjoin a passage for the cold condensed gas.

What is claimed is:

1. Method for cooling a product, preferably in gas or liquid form, using the cooling content of a condensed gas, wherein the condensed gas is vaporized in a vaporization heat exchanger arrangement and the product is cooled in a product-cooling heat exchanger arrangement, both the said vaporization and the product-cooling take place under energy exchange with the gas to be vaporized, using for said heat exchanger arrangements a combined arrangement comprising a plurality of separate passages for the vaporization of the condensed gas, for the vaporized gas, and for the product to be cooled, which are in heat-transferring contact with one another and are used for the different media, coupling at least the passages intended for vaporization of the condensed gas in parallel between an inlet and an outlet, and supplying the media to the inlet ends of the passages so that between a passage for the condensed gas and a passage for the product to be cooled there is at all times at least one passage through which vaporized gas flows.

2. Method according to claim 1, characterized in that the passages for each medium are coupled in parallel, and in that the common outlet from the passages supplied with the condensed gas is coupled to the common inlet of the passages for the vaporized gas.

3. Method according to claim 2, characterized in that the said outlet and inlet are coupled together in such a way that the vaporized gas comes to flow in counter-current direction in relation to the direction of flow of the product.

4. Method according to claim 1, characterized in that the passages for the vaporized gas and/or the passages for the product to be cooled are coupled in series with each other between associated inlet and outlet.

5. Method according to any of claims 1 to 4, characterized in that, as said combined heat exchanger arrangement, use is made of an arrangement with a plurality of column-shaped passages which are disposed side by side and are separated by partition walls with a large heat-transfer surface area.

6. Arrangement for cooling a product, preferably in gas or liquid form, using the cooling content of a condensed gas, which arrangement comprises a heat exchanger arrangement for vaporization of the condensed gas and a heat exchanger arrangement for cooling of the product, which heat exchanger arrangements both work under energy exchange with the condensed gas, and are combined in a common arrangement comprising a plurality of passages for the vaporization of the condensed gas, for the vaporized gas, and for the product to be cooled, which are in heat-transferring contact with one another and are used for the different media, and which passages are separated from each other and are arranged in such a way that between a passage for the condensed gas and a passage for the product to be cooled there is at all times at least one passage for the vaporized gas, characterized in that the passages intended for vaporization of the condensed gas are coupled in parallel between an inlet and an outlet.

7. Arrangement according to claim 6, characterized in that the passages for each medium are coupled in parallel, and in that the common outlet from the passages for the condensed gas is coupled to the common inlet of the passages for the vaporized gas.

8. Arrangement according to claim 6, characterized in that the passages for the vaporized gas and/or the passages for the product to be cooled are coupled in series with each other between associated inlet and outlet.

9. Arrangement according to any of claims 6 to 8, characterized in that the combined heat exchanger arrangement comprises a plurality of column-shaped passages which are disposed side by side and are separated by partition walls with a large heat-transfer surface area.

10. Arrangement according to claim 6, characterized in that the passages for vaporization of the condensed gas and the passages for cooling of the product are arranged at a distance from each other in a closed container, in that the passages intended for vaporization of the condensed gas are connected at their ends to a common inlet at one end of the container, in that the other ends of these passages are open at the opposite end of the container, and in that the vaporized gas which flows out from these ends flows back to a common outlet at the said first end of the container via column-shaped passages between the passages, which are arranged in the container, for condensed gas and, respectively, the product to be cooled.

* * * * *